US006342879B1

(12) United States Patent
Hantom

(10) Patent No.: US 6,342,879 B1
(45) Date of Patent: Jan. 29, 2002

(54) JOYSTICK ACTUATORS

(75) Inventor: Andrew Hantom, Cheltenham (GB)

(73) Assignee: Ultronics Limited, Gloucestershire (GB)

( * ) Notice: Subject to any disclaimer, the term of this patent is extended or adjusted under 35 U.S.C. 154(b) by 0 days.

(21) Appl. No.: 09/351,184

(22) Filed: Jul. 12, 1999

(30) Foreign Application Priority Data

Jul. 10, 1998 (GB) ..... 9814895

(51) Int. Cl.[7] ..... G09G 5/08
(52) U.S. Cl. ..... 345/161; 345/166
(58) Field of Search ..... 345/156, 161, 345/162, 166; 356/152.1; 250/214 PR, 214 R, 221

(56) References Cited

U.S. PATENT DOCUMENTS 3,395,287 A * 7/1968 Rajac ..... 250/221
3,811,047 A * 5/1974 Shragal ..... 250/204
3,881,106 A 4/1975 Pocker et al. ..... 250/234
4,250,378 A 2/1981 Mutton ..... 250/221
4,445,541 A * 5/1984 Schmiel ..... 137/636.2
4,459,022 A 7/1984 Morey ..... 356/152
4,686,361 A * 8/1987 Bard ..... 250/221
4,731,530 A * 3/1988 Mikan ..... 250/229
4,825,157 A * 4/1989 Mikan ..... 324/207.2
5,532,476 A * 7/1996 Mikan ..... 250/221
5,694,153 A * 12/1997 Aoyagi et al. ..... 345/161
5,949,404 A * 9/1999 Zabel ..... 345/161

* cited by examiner

*Primary Examiner*—Bipin Shalwala
*Assistant Examiner*—Jeff Piziali
(74) *Attorney, Agent, or Firm*—Young & Thompson

(57) ABSTRACT

A joystick actuator includes a fixed housing, a joystick member which is manually movable relative to the housing in at least one direction and which incorporates a light transmitter, a detection circuit within the housing incorporating at least two position sensing light detectors for receiving light of varying intensity from the light transmitter as the joystick member is moved in the at least one direction and a further light detector between the two position sensing light detectors. The actuator also includes parts in the detection circuit for making use of the output signal of the further light detector to linearize or substantially linearize the output signals of the position sensing light detectors. The detection circuit is arranged to provide an electrical output signal dependent on the light received by the light detectors and indicative of the position or rate of movement of the joystick member.

14 Claims, 3 Drawing Sheets

FIG 5
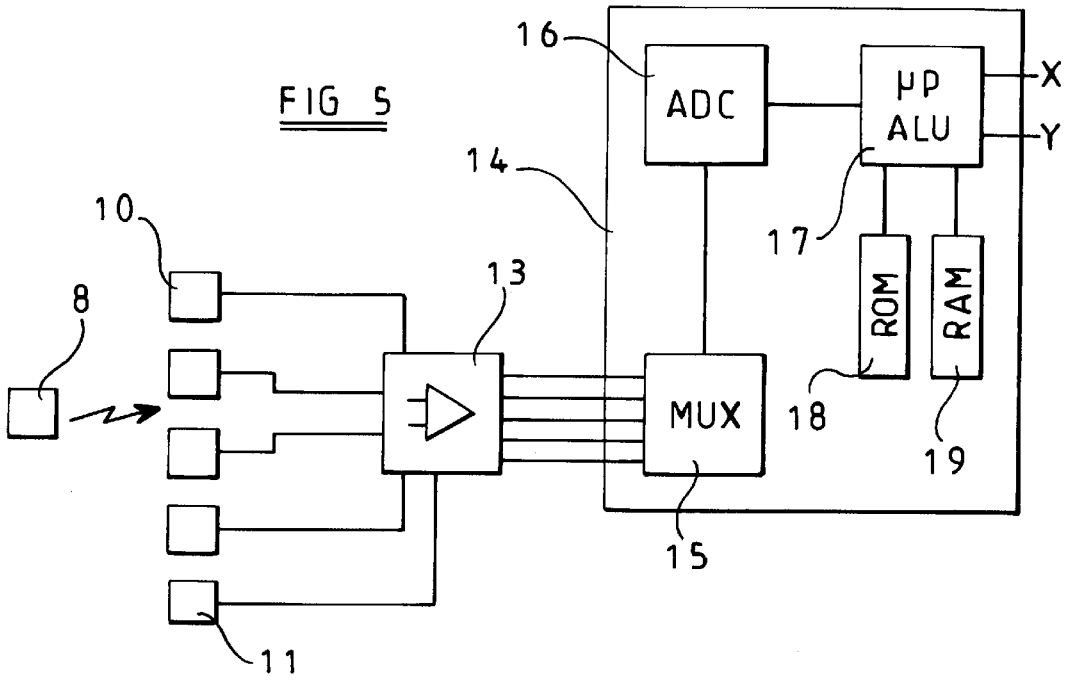
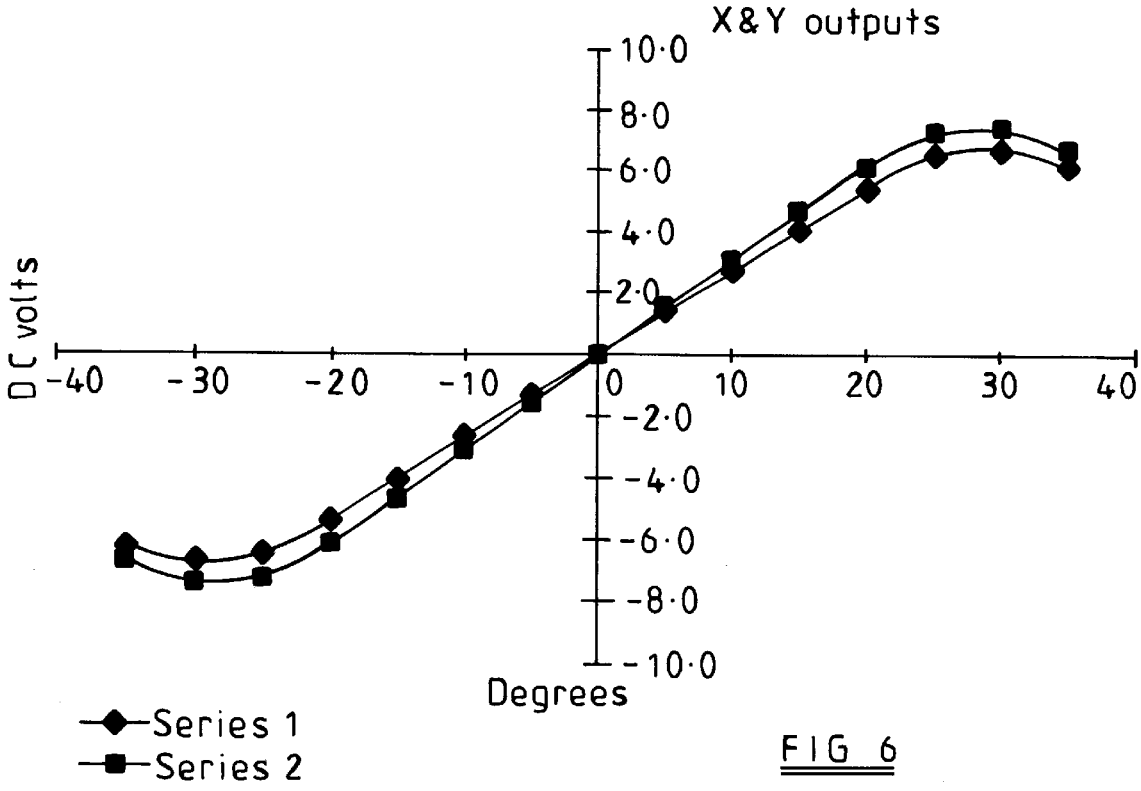
FIG 6

JOYSTICK ACTUATORS

INTRODUCTION

This invention relates to joystick actuators.

Joystick actuators are used in a number of applications in which accurate manual control of an electrical, mechanical or hydraulic system is required, generally in two dimensions. Such joystick actuators have a handle adapted to be grasped by the operator and to be manipulated in order to vary an electrical output signal from the actuator in such a manner as to control the system in a manner determined by operator actuation. It is known for such joystick actuators to incorporate potentiometers or sensing coils for providing an output signal dependent on the position, or the rate of movement, of the handle. However such known arrangements suffer from the fact that they incorporate wearing parts and/or are costly to manufacture.

SUMMARY OF THE INVENTION

It is an object of the invention to provide an improved joystick actuator which can be produced in a straightforward manner and which is capable of a long service life.

The invention is defined by the accompanying claims.

It should be understood that the term "light" is used in this specification to denote electromagnetic radiation within a wide range of wavelengths and is not limited to wavelengths within the visible spectrum.

In order that the invention may be more fully understood, a preferred embodiment of joystick actuator in accordance with the invention will now be described, by way of example, with reference to the accompanying drawings.

BRIEF DESCRIPTION OF THE DRAWINGS

FIG. 5 is a diagram of the detection circuit of the actuator,

FIG. 6 is a graph showing the output voltages of the position sensing light detectors as the joystick member moves along the X and Y axis.

DESCRIPTION OF THE PREFERRED EMBODIMENT

Figure 1:
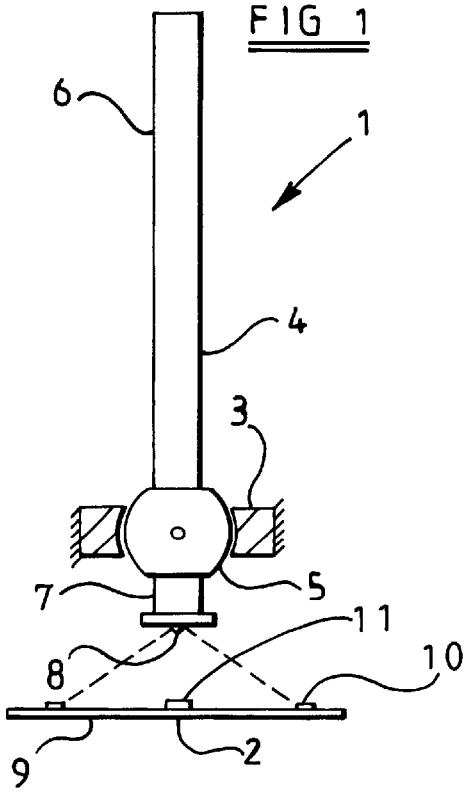
FIGS. 1 and 2 are vertical sections through the actuator in two different positions.
Figure 2:
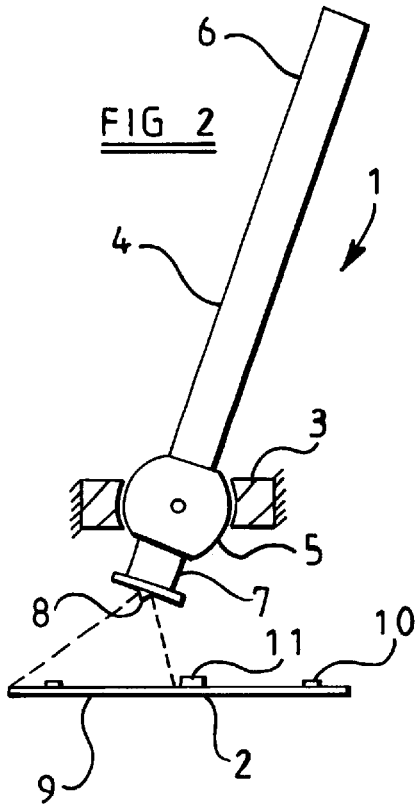

Referring to FIGS. 1 and 2, the joystick actuator 1 comprises a detection circuit 2 within a housing 3 (shown only partially in the drawings), and a joystick member 4 which is pivotally mounted by a ball and socket joint 5 so as to be pivotable in two mutually transverse directions relative to the housing 3. The joystick member 4 has a handle 6 projecting upwardly and outwardly of the housing 3 and adapted to be grasped and manipulated by the operator, and an end part 7 within the housing 3 bearing a light transmitter in the form of a light-emitting diode 8 thereon. The detection circuit 2 within the housing 3 comprises a printed circuit board 9, four position sensing light detectors (only two of which are shown in FIGS. 1 and 2) in the form of photosensitive diodes 10, a further light detector in the form of a photosensitive diode 11 and associated processing circuitry.

The diodes 10 are symmetrically positioned in relation to a mean position of the joystick member and the diode 11 is positioned centrally within the diodes 10.

Figure 3:
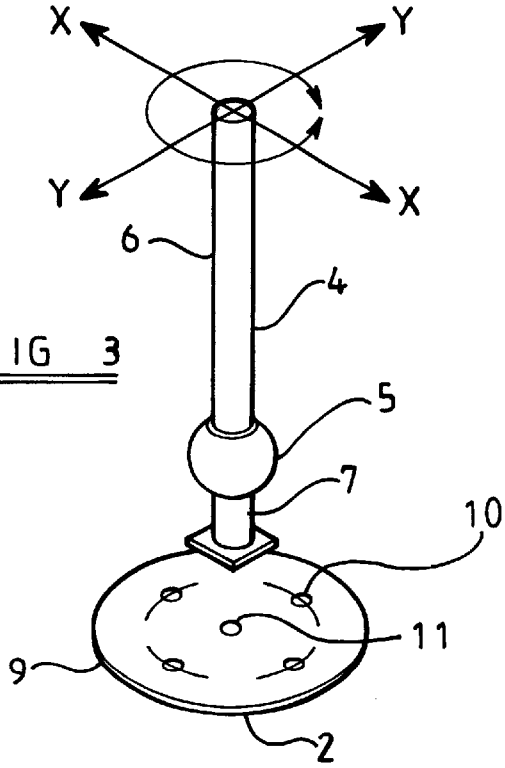
FIGS. 3 and 4 are diagrammatic perspective view of the joystick member of the actuator in the two positions.
Figure 4:
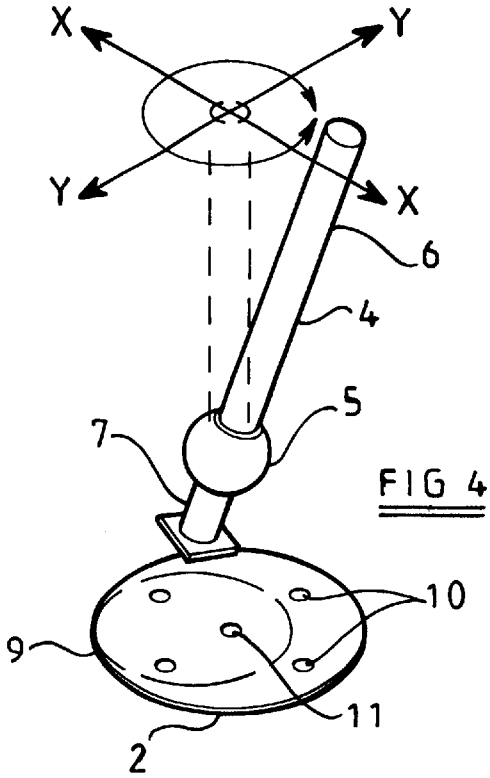

As will more readily be appreciated by referring to FIGS. 3 and 4, manipulation of the joystick member 4 between a central position (FIGS. 1 and 3) and an extreme position (FIGS. 2 and 4) results in movement of the light-emitting diode 8 relative to the diodes 10 in such a manner as to decrease the light level received by at least one of the diodes 10 and to increase the light level received by at least one other of the diodes 10. Thus, in the illustrated example, movement of the joystick member 4 from the central position to the extreme position along the direction X—X will result in the supply of signals dependent on the received light levels from the diodes 10 to the processing circuitry to produce an electrical output signal indicative of both the direction and the degree of movement of the joystick member 4. Similarly electrical output signals indicative of the direction and degree of movement of the joystick member 4 will be given when movement of the joystick actuator 4 is in the direction Y—Y, or when X movements and Y movements are combined so as to move the joystick member 4 along a direction intermediate the X—X and Y—Y directions.

As the joystick member 4 moves so that the light emitted by the diode 8 approaches one of the photodiodes 10, the output of the photodiode 10 will increase and will peak when the diode 10 receives maximum light intensity from the diode 8. Further movement of the diode 8 in the same direction will result in the output of the photodiode 10 falling again. FIG. 6 shows two curves, one representing the combined outputs of the photodiodes 10 (with one output inverted with respect to the other) aligned with the X—X direction and the other representing the combined outputs of the photodiodes 10 (with one output inverted with respect to the other) aligned with the Y—Y direction. It will be noted that these curves peak and then fall off as the light from the diode 8 passes over the then moves away from each photodiode 10. For example, a voltage of 6.5 volts will indicate two possible positions of the joystick member 4. In one of these the axis of the joystick member 4 intersects a plane containing the four diodes 10 within a circle passing through the diodes 10. In the other, the axis of the joystick member 4 intersects said plane outside the said circle.

The further diode 11 is located within the said circle and at the center of the said circle so that it will lie directly below the diode 8 when the actuator is at rest, spring centered and equidistant from the four photodiodes 10.

Figure 7:
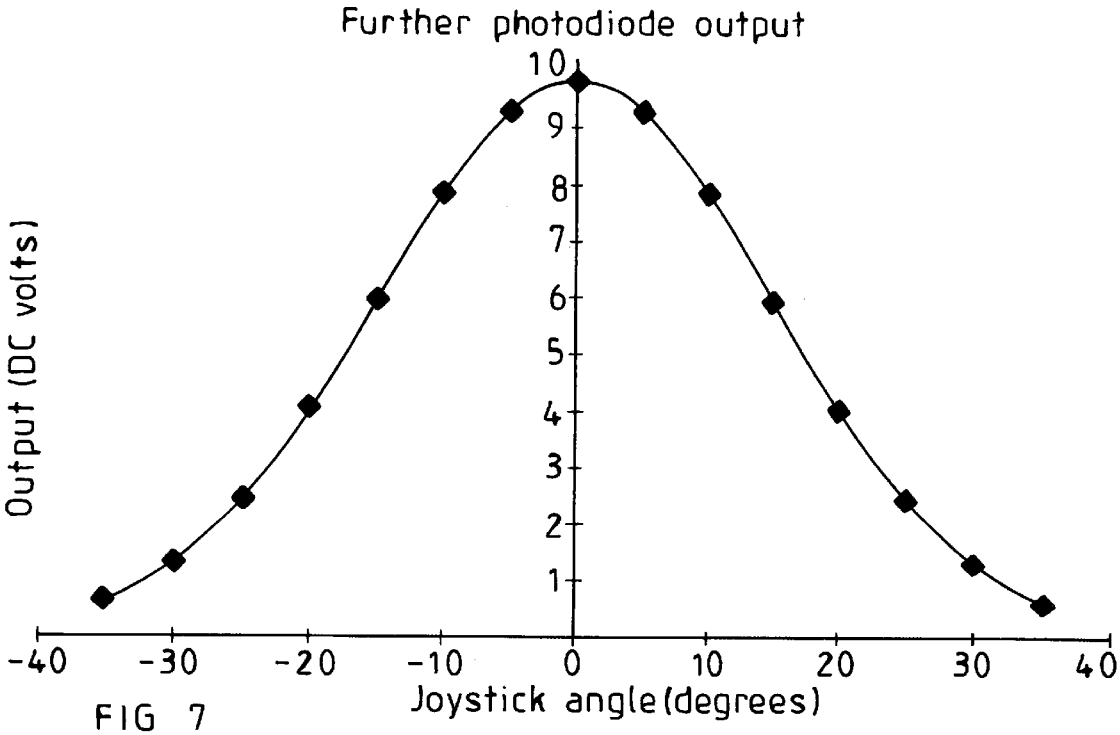
FIG. 7 is a graph showing the output voltage of the further light detector.
Figure 8:
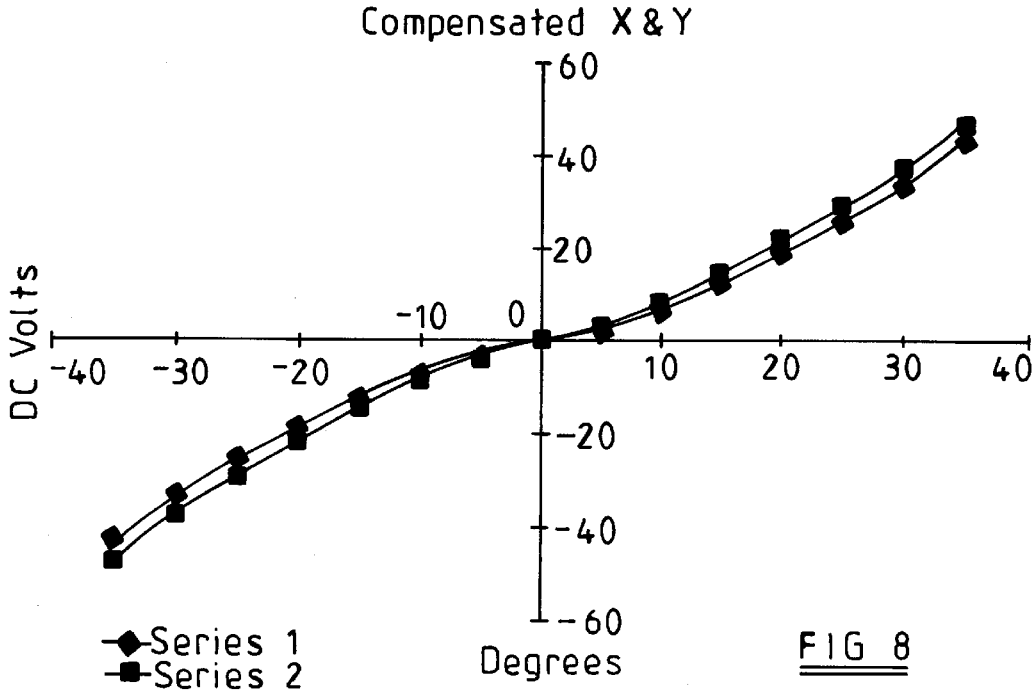
FIG. 8 is a graph showing a proportion of the output voltage of the further light detector summed with the output voltages of the position sensing light detectors.

The output voltage of the further photodiode 11 follows a curve of the type shown in FIG. 7 and this is used to modify the outputs of the position sensing photodiodes 10 such that the latter outputs are substantially linearized as shown in FIG. 8. This is generally achieved by summing a proportion of the output from the photodiode 11 with each of the outputs of the position sensing photodiodes 10 although ideally some additional processing may also be carried out on the outputs of the photodiodes 10 by performing an algorithm on these outputs.

Referring to FIG. 5, the signals outputted by the photodiodes 10 and 11 are supplied to a transimpedance circuit 13 comprising a respective amplifier with gain for converting the current output signal from each photodiode 10, 11 to a voltage signal, the five resulting voltage signals being supplied to a multiplexer 15 of a microprocessor 14. The multiplexer 15 supplies an analogue output signal indicative of its five inputs to an analogue-to-digital converter which converts the signal to an 8-bit binary signal. An arithmetic logic unit 17 is provided with a read-only memory 18 containing a program code and a random-access memory 19 for temporarily storing program values. The binary values indicative of the light levels received by the five photodiodes 10 are processed in the arithmetic logic unit 17. The arithmetic logic unit 17 performs an algorithm on the binary values and provides outputs X and Y indicative of the X and Y positions of the joystick member.

The microprocessor 14 can also compare the signal from the photodiode 11 with the signals from the photodiodes 10 and use the signal from the photodiode 11 to validate the signals from the photodiodes 10. If any of the signals from the photodiodes 10 change but the signal from the photodiode 11 does not change, this will indicate that the signal from the photodiode 10 is not valid. This safety feature will prevent unexpected outputs from the joystick actuator in the event that one or more components develop a fault condition.

The above embodiment is given by way of example only and various modifications will be apparent to persons skilled in the art without departing from the scope of the invention. For example, the light emitting diode 8 could be replaced by a light reflector mounted on the joystick member and arranged to reflect light from a fixed light source within the housing.

What is claimed is:

1. A joystick actuator comprising a fixed housing, a joystick member which is manually movable relative to the housing in at least one direction and which incorporates a light transmitter, a detection circuit within the housing incorporating at least two positions sensing light detectors for receiving light of varying intensity from the light transmitter as the joystick member is moved in said at least one direction and a further light detector between the said at least two position sensing light detectors, and means in the detection circuit for making use of the output signal of the further light detector to linearize or substantially linearize the output signals of the position sensing light detectors, the detection circuit being arranged to provide an electrical output signal dependent on the light received by the light detectors and indicative of the position or rate of movement of the joystick member.

2. An actuator according to claim 1, wherein the joystick member is pivotally mounted relative to the housing so as to be pivotable in said at least one direction by manual operation of a handle portion of the joystick member.

3. An actuator according to claim 2, wherein the joystick member is pivotally mounted relative to the housing by means of a ball and socket joint.

4. An actuator according to claim 1, wherein the light transmitter comprises a light source mounted on the joystick member.

5. An actuator according to claim 4, wherein the light source is a lightemitting diode.

6. An actuator according to claim 1, wherein the light transmitter comprises a light reflector mounted on the joystick member and arranged to reflect light from a fixed light source within the housing.

7. An actuator according to claim 1, wherein the joystick member is manually movable relative to the housing in two mutually transverse directions, and the detection circuit incorporates at least two position sensing light detectors.

8. An actuator according to claim 7, wherein the detection circuit incorporates four position sensing light detectors symmetrically positioned in relation to a mean position of the joystick member.

9. An actuator according to claim 1, wherein the further light detector is directly aligned with the light transmitter when the joystick member is in a mean position.

10. An actuator according to claim 1, wherein the detection circuit compares the output signal of the position sensing light detectors with the output signal of the further light detector to indicate a fault condition.

11. An actuator according to claim 1, wherein the light detectors are mounted on a common circuit board.

12. A joystick actuator, comprising:

a housing;

a joystick extending into the housing and movable relative to the housing, the joystick having an end surface perpendicular of a longitudinal axis of the joystick;

a light transmitter mounted through the end surface;

a detection circuit having at least two position-sensing light detectors mounted on a surface spaced apart from the end surface; and a further light detector located intermediate the position-sensing light detectors, the further light detector connected to the detection circuit, the detection circuit signal an output signal of the further light detector to linearize output signals of the position-sensing light detectors, the detection circuit including an electrical output providing an output signal dependent on the light received by the position-sensing light detectors and the further light detector and indicative of the position or rate of movement of the joystick.

13. A joystick actuator of claim 12, wherein the position-sensing light detectors are mounted on a circuit board positioned parallel to the end surface when the joystick is in a neutral position.

14. A joystick actuator of claim 13, comprising at least four position-sensing light detectors mounted on a circuit board and surrounding the further light detector.

* * * * *